US011498810B2

(12) United States Patent
Naruke

(10) Patent No.: US 11,498,810 B2
(45) Date of Patent: Nov. 15, 2022

(54) POSITION ADJUSTING DEVICE AND METHOD FOR ELEVATOR FRAME, ELEVATOR FRAME AND ELEVATOR

(71) Applicant: Otis Elevator Company, Farmington, CT (US)

(72) Inventor: Alberto Senzo Naruke, Chiba (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 94 days.

(21) Appl. No.: 17/095,495

(22) Filed: Nov. 11, 2020

(65) Prior Publication Data

US 2021/0300725 A1 Sep. 30, 2021

(30) Foreign Application Priority Data

Mar. 24, 2020 (CN) ..... 202010212249.4

(51) Int. Cl.
*B66B 11/02* (2006.01)

(52) U.S. Cl.
CPC ..... *B66B 11/0213* (2013.01); *B66B 2201/306* (2013.01)

(58) Field of Classification Search
CPC .. E04G 5/00; B66B 11/0213; B66B 2201/306
USPC ..... 182/186.6, 182.1
See application file for complete search history.

(56) References Cited

U.S. PATENT DOCUMENTS 3,863,900 A * 2/1975 Dagiel ..... E04G 21/3233 248/231.71
4,216,933 A * 8/1980 Cramer, Jr. ..... E04G 5/00 248/346.06
4,363,467 A * 12/1982 Bos ..... E04F 11/181 52/704
5,279,393 A * 1/1994 Lloyd ..... B66B 7/046 414/282
5,484,229 A * 1/1996 Reece ..... E01C 19/185 404/110
6,039,150 A * 3/2000 Palmer ..... E04G 21/3223 182/113
6,260,311 B1 * 7/2001 Vladikovic ..... E04G 11/28 52/114
7,234,689 B2 * 6/2007 Kuenzel ..... E04G 21/3233 182/113
8,251,186 B2 * 8/2012 Webster ..... B66B 7/04 187/401

(Continued)

FOREIGN PATENT DOCUMENTS

CN 107447970 A * 12/2017
CN 2018112210668 * 10/2018

*Primary Examiner* — Michael A Riegelman
(74) *Attorney, Agent, or Firm* — Cantor Colburn LLP

(57) ABSTRACT

A position adjusting device and method for elevator frame, an elevator frame, and an elevator. The position adjusting device includes: a connection portion configured to be suitable for being selectively attached to a side surface of a vertical connection member for elevator frame; a matching portion extending on a plane perpendicular to the connection portion, and including one or more threaded through holes; and one or more adjusting mechanisms including a head and a threaded rod, the rod being configured to match the threaded through hole, and a tip of the rod being configured to be suitable for matching with the surface of a horizontal connection member for elevator frame.

12 Claims, 3 Drawing Sheets

(56) References Cited

U.S. PATENT DOCUMENTS

| | | | | |
|---|---|---|---|---|
| 9,708,161 | B2 * | 7/2017 | Geroso | B66B 7/046 |
| 10,938,190 | B1 * | 3/2021 | Goelst | A47B 97/00 |
| 2005/0265786 | A1 * | 12/2005 | Gresser | E01C 19/187 404/118 |
| 2009/0184302 | A1 * | 7/2009 | Begin | E04F 11/1812 256/65.04 |
| 2020/0122970 | A1 * | 4/2020 | Naruke | B66B 5/28 |
| 2021/0300725 | A1 * | 9/2021 | Naruke | B66B 11/0213 |

* cited by examiner

POSITION ADJUSTING DEVICE AND METHOD FOR ELEVATOR FRAME, ELEVATOR FRAME AND ELEVATOR

FOREIGN PRIORITY

This application claims priority to Chinese Patent Application No. 202010212249.4, filed Mar. 24, 2020, and all the benefits accruing therefrom under 35 U.S.C. § 119, the contents of which in its entirety are herein incorporated by reference.

TECHNICAL FIELD

This application relates to the field of assembly and adjustment of elevator structures. More specifically, the present application relates to a position adjusting device for elevator frame, which provides adjustment of relative position between frame components during assembling of the elevator frame. The present application also relates to a position adjusting method for elevator frame. The present application also relates to an elevator frame including the position adjusting device described above, and an elevator including the position adjusting device described above or the elevator frame described above.

BACKGROUND ART

Elevators often contain elevator frames to support cars and other components. An elevator frame typically includes a plurality of horizontal connection members and a plurality of vertical connection members. In the elevator frame of typical jumping elevator, double-deck or double-car elevator, the vertical connection members are arranged around the periphery of the horizontal connection members and have a relatively large dimension in vertical direction. For example, the vertical connection member may have a vertical dimension of 5 to 6 meters. These vertical connection members are required to be relatively fixed with the horizontal connection members. However, the relatively large vertical dimension of the vertical connection members are prone to cause problems such as offset, distortion or mismatch of the distal ends of the vertical connection members and so on, which adversely affects the assembling of the elevator frame.

Therefore, there is a continuing need for new elevator frame assembling solutions. It is desired that the new solution can alleviate the aforementioned problem at least to some extent.

SUMMARY OF INVENTION

An object of one aspect of the present application is to provide a position adjusting device for elevator frame, which aims to provide a flexible and reliable adjustment of the relative position of elevator frame components. An object of another aspect of the present application is to provide a position adjusting method for elevator frame. An object of another aspect of the present application is to provide an elevator frame including the position adjusting device described above. An object of further aspect of the present application is to provide an elevator including the position adjusting device or the aforementioned elevator frame described above.

The objects of the present application are achieved through the following technical solutions: a position adjusting device for elevator frame, comprising: a connection portion configured to be suitable for being selectively attached to a side surface of a vertical connection member for elevator frame; a matching portion extending on a plane perpendicular to the connection portion and including one or more threaded through holes; and one or more adjusting mechanisms including a head and a threaded rod, the rod being configured to match with the threaded through hole, and a tip of the rod being configured to be suitable for matching with a surface of a horizontal connection member for elevator frame.

In the aforementioned position adjusting device, optionally, the connection portion is configured to be removably attached to the side surface of the vertical connection member for elevator frame.

In the aforementioned position adjusting device, optionally, the connection portion is provided with a plurality of mounting holes, and the connection portion is attached to the side surface of the vertical connection member for elevator frame through the plurality of mounting holes In the aforementioned position adjusting device, optionally, the connection portion is attached to the side surface of the vertical connection member for elevator frame by welding.

In the aforementioned position adjusting device, optionally, one or more reinforcing ribs are attached between the matching portion and the connection portion.

In the aforementioned position adjusting device, optionally, the adjusting mechanism includes a bolt.

In the aforementioned position adjusting device, optionally, the one or more threaded through holes are configured to extend in a vertical direction.

A position adjusting method for elevator frame, comprising the following steps: positioning a plurality of vertical connection members for elevator frame adjacent to a horizontal connection member for elevator frame; disposing a position adjusting device for elevator frame described above on a side surface of the vertical connection member for elevator frame, such that tips of the rods of the one or more adjusting mechanisms are adjacent to the surface of the horizontal connection member for elevator frame; adjusting a relative positional relationship between the vertical connection member for elevator frame and the horizontal connection member for elevator frame by rotating the rod; and fixing the vertical connection member for elevator frame with respect to the horizontal connection member for elevator frame.

In the aforementioned position adjusting method, optionally, adjusting the relative positional relationship between the vertical connection member for elevator frame and the horizontal connection member for elevator frame comprises: adjusting front to back alignment relationship, adjusting the torsion angle of the vertical connection member for elevator frame, or adjusting a position of the vertical connection member for elevator frame in a vertical direction.

In the aforementioned position adjusting method, optionally, fixing the vertical connection member for elevator frame with respect to the horizontal connection member for elevator frame includes fixing by bolts or welding.

In the aforementioned position adjusting method, optionally, after the vertical connection member for elevator frame is fixed with respect to the horizontal connection member for elevator frame, the position adjusting device for elevator frame is removed.

An elevator frame comprising: at least two horizontal connection members; a vertical connection member matching with each of the horizontal connection members; a plurality of position adjusting devices described above, the connection portions of each position adjusting device being respectively attached to each of the vertical connection members, and the tips of the rods being cooperative with the top surface of the vertical connection member, so as to adjust the relative positional relationship between the horizontal connection member and the vertical connection member.

An elevator comprising the position adjusting device described above, or the elevator frame described above.

The position adjusting device and method for elevator frame, the elevator frame and the elevator of the present application have the advantages of being simple and reliable, easy to implement, convenient in usage, etc., and can flexibly adjust the relative position between the components of the elevator frame during the assembly process, so as to improve accuracy in assembling.

BRIEF DESCRIPTION OF THE DRAWINGS

The present application will be described in further detail below in conjunction with the drawings and preferred embodiments. Those skilled in the art will appreciate that these drawings are drawn only for the purpose of explaining the preferred embodiments and therefore should not be taken as limitation of the scope of the application. In addition, unless specifically specified, the drawings are only intended to conceptually represent the composition or construction of the described objects and may include exaggerated illustration. The drawings are not necessarily drawn to scale.

DETAILED DESCRIPTION

Figure 1:
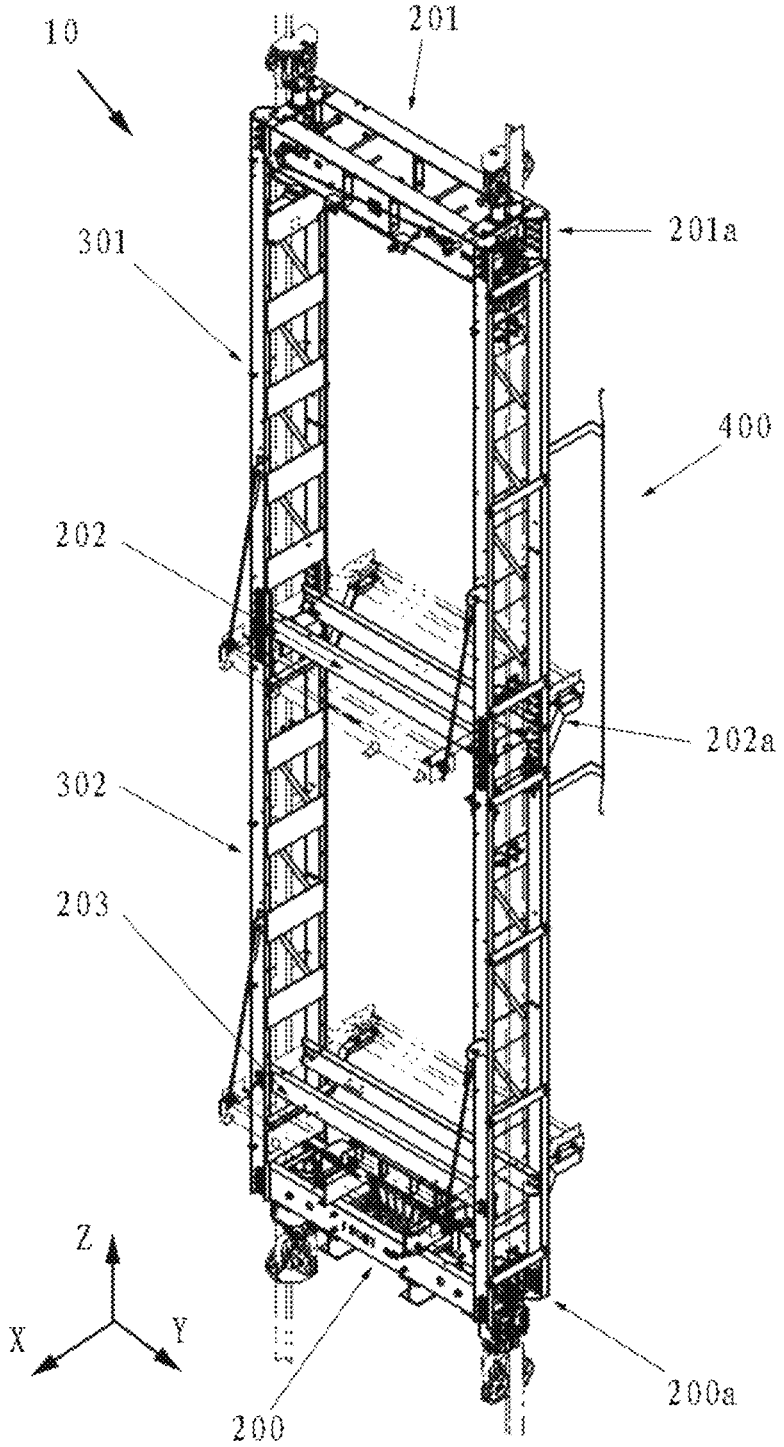
FIG. 1 is a structural schematic diagram of an elevator frame according to one embodiment of the present application.

Hereinafter, preferred embodiments of the present application will be described in detail with reference to the accompanying drawings. Those skilled in the art will appreciate that these descriptions are merely descriptive, exemplary, and should not be construed as limiting the scope of protection of the present application.

First of all, it should be noted that the oriental terms "top", "bottom", "upward" and "downward" and the like mentioned herein are defined relative to the directions in the drawings. These orientations are relative concepts and will therefore vary according to their positions and states. Therefore, these and other oriental terms should not be construed as limiting.

In addition, it should also be noted that for any single technical feature described or implied in the embodiments herein or any single technical feature shown or implied in the drawings, it is possible to continue to combine these technical features (or their equivalents), so as to obtain other embodiments that are not directly mentioned herein.

It should be noted that in different drawings, the same reference numerals indicate the same or substantially the same assemblies.

The "vertical direction" referred to herein refers to the direction of gravity, i.e., the direction of Z axis in FIG. 1. The "horizontal direction" referred to herein refers to the direction that is on the plane perpendicular to the vertical direction, e.g. the direction of X or Y axes in FIG. 1.

FIG. 1 is a structural schematic diagram of an elevator frame according to one embodiment of the present application. The elevator frame 10 includes vertical connection members 300, 400 and horizontal connection members 200, 201, 202, and 203. Each horizontal connection member is disposed substantially in the horizontal direction, and both ends of each horizontal connection members are connected to the vertical connection member, respectively. In one embodiment, each horizontal connection member is attached onto the vertical connection member by welding. For example, the horizontal connection member 200 is connected to the vertical connection member 400 at the connection portion 200*a*, the horizontal connection member 202 is connected to the vertical connection member 400 at the connection portion 202*a*, and the horizontal connection member 201 is connected to the vertical connection member 400 at the connection portion 201*a*. Horizontal connection members may be configured to be vertically spaced apart from each other, so as to provide sufficient space in the elevator frame 10 for mounting other elevator components, including, but not limited to, cars and the like. For example, in the illustrated embodiment, the vertical connection member 300 is also referred to as an upright. The first section 301 of the vertical connection member 300 between the horizontal connection member 201 and the horizontal connection member 202 is also referred to as an upper upright, and the second section 302 of the vertical connection member 300 between the horizontal connection member 202 and the horizontal connection member 203 is also referred to as a lower upright. The horizontal connection member 200 located below the horizontal connection member 203 is also referred to as a plank. The horizontal connection members 202 and 203 respectively provide decks for mounting a car. Therefore, the horizontal connection member 202 is also referred to as an upper deck, and the horizontal connection member 203 is also referred to as a lower deck.

In one embodiment of the present application, the aforementioned horizontal connection members and vertical connection members are separately manufactured from metal material and then assembled together. The metal material may be, for example, structural steel. In a typical jumping elevator or double-deck elevator, it is required that the elevator frame 10 shall has sufficient height to accommodate elevator components such as a car and the like. Therefore, the vertical connection members in such elevators usually have a relatively larger dimension in vertical direction. In one embodiment of the present application, the vertical dimension of the vertical connection member 300 (the dimension along the Z axis in FIG. 1) may be about 5.6 meters, for example.

Due to the relatively larger dimension in vertical direction of the vertical connection member, when the vertical connection member is matched with the horizontal connection member at both ends thereof and relatively fixed, the vertical connection member may have various undesired mismatches. For example, when the vertical connection member 300 is connected to the horizontal connection member 200, the side of the vertical connection member 300 that is closer to the horizontal connection member 201 may have a variety of undesired deviations in the relative positional relationship: offset in the direction of the X axis in FIG. 1, offset in the direction of the Y axis, distortion around the direction of the Z axis (or a vertical direction), or mismatch of the side of the vertical connection member 400 that is closer to the horizontal connection member 201.

In the existing elevator frame 10, the above-mentioned various deviations are usually solved by adjusting the welding operation. However, such operations may bring tolerance or produce potential stress.

Figure 2:
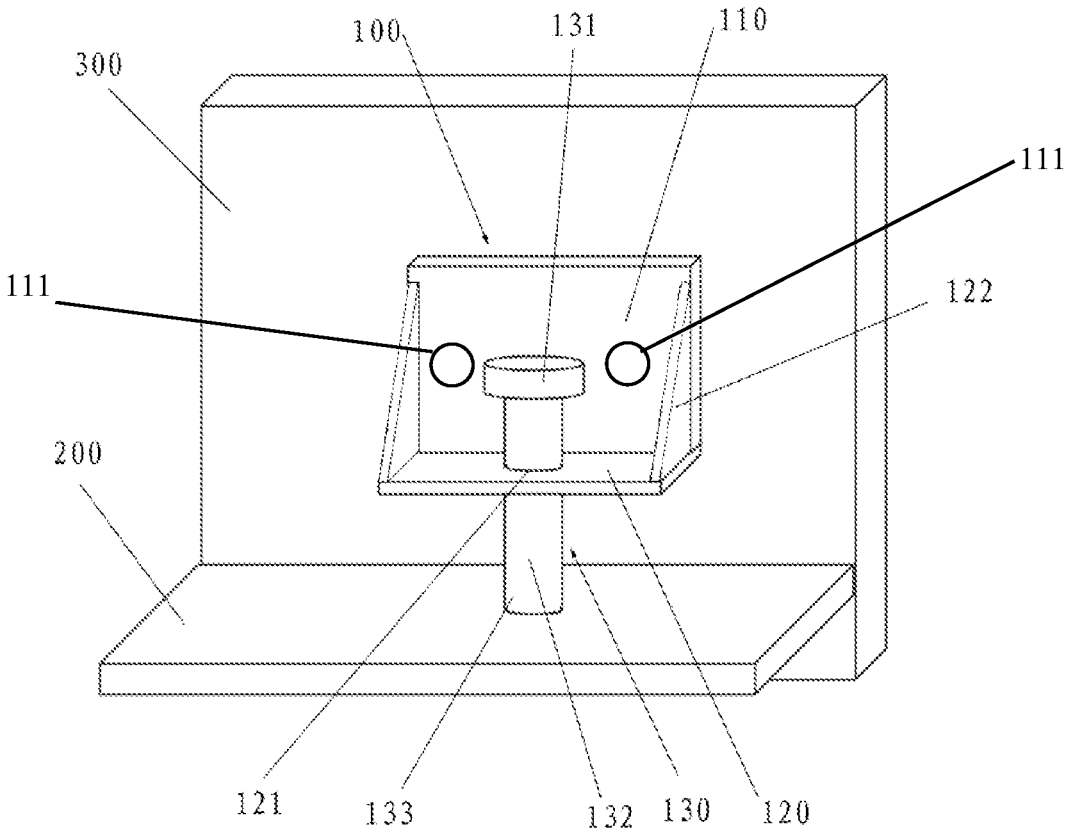
FIG. 2 is a schematic perspective view of a position adjusting device according to one embodiment of the present application.

FIG. 2 is a schematic perspective view of the position adjusting device according to one embodiment of the present application. A portion of the horizontal connection member 200 and the vertical connection member 300 is schematically shown in FIG. 2. The horizontal connection member 200 is disposed substantially in the horizontal direction, and the vertical connection member 300 is disposed against an edge of the horizontal connection member 200. The position adjusting device 100 for elevator frame according to the present application is also schematically shown in FIG. 2. The position adjusting device 100 includes: a connection portion 110, a matching portion 120, and one or more adjusting mechanisms 130.

The connection portion 110 is configured to be suitable for being selectively attached to the side surface of the vertical connection member 300 for elevator frame 10. The other side of the connection portion 110 not shown in FIG. 2 may have a shape suitable for matching with the side surface of the vertical connection member 300. The connection portion 110 may be fixed to the side surface of the vertical connection member 300 by bolts, and may also be attached to the side surface of the vertical connection member 300 by welding or other joining means. Bolts and bolt holes for fixing the connection portion 110 to the side surface of the vertical connection member 300 may be provided. For example, mounting holes 111 shown in FIG. 2 may receive bolts for fixing or attaching the connection portion 110 to the side surface of the vertical connection member 300. It is readily understood that a plurality of bolt holes may be provided separately on the connection portion 110, and corresponding bolt holes are provided on the side surface of the vertical connection member 300 so as to fix the connection portion 110.

The connection portion 110 may be configured to be fixed to the side surface of the vertical connection member 300 and may also be configured to be removably attached to the side surface of the vertical connection member 300.

The matching portion 120 extends on a plane perpendicular to the connection portion 110 and includes one or more threaded through holes 121. One or more reinforcing ribs 122 may be provided between the matching portion 120 and the connection portion 110. In the illustrated embodiment, the matching portion 120 is provided with only one single through hole 121, and the reinforcing ribs 122 are provided at the edges of both sides of the matching portion 120. One side of the reinforcing rib 122 is attached to the matching portion 120, and the other side is attached to the connection portion 110. The connection portion 110, the matching portion 120, and the reinforcing rib 122 may be manufactured integrally, or may be configured as separate components that are attached together by connection methods such as welding after the manufacturing is completed. The through hole 121 may be configured with an internal thread. In the illustrated embodiment, the through hole 121 is configured to extend substantially in the vertical direction.

The adjusting mechanism 130 includes a head 131 and a threaded rod 132. The rod 132 may be configured with an external thread and matches with the threaded through hole 121. The tip 133 of the rod 132 may be configured to be suitable for matching with the surface of the horizontal connection member 200, for example, the top surface of the horizontal connection member 200. In one embodiment, the adjusting mechanism 130 is a bolt, and the head 131 has a structure for rotating the adjusting mechanism 130. When the operator rotates the head 131 with a tool such as a wrench, the rod 132 will rotate with the head 131 and be guided to move in the vertical direction by the thread of the through hole 121, thereby driving the tip 133 to ascend or descend in the vertical direction. Therefore, by rotating the adjusting mechanism 130, it is possible to change the relative vertical position between the horizontal connection member 200 and the vertical connection member 300, or to slightly adjust the relative angle between the horizontal connection member 200 and the vertical connection member 300, thereby adjusting the orientation, relative angle or torsion of the other end of the vertical connection member 300 (not shown).

Figure 3:
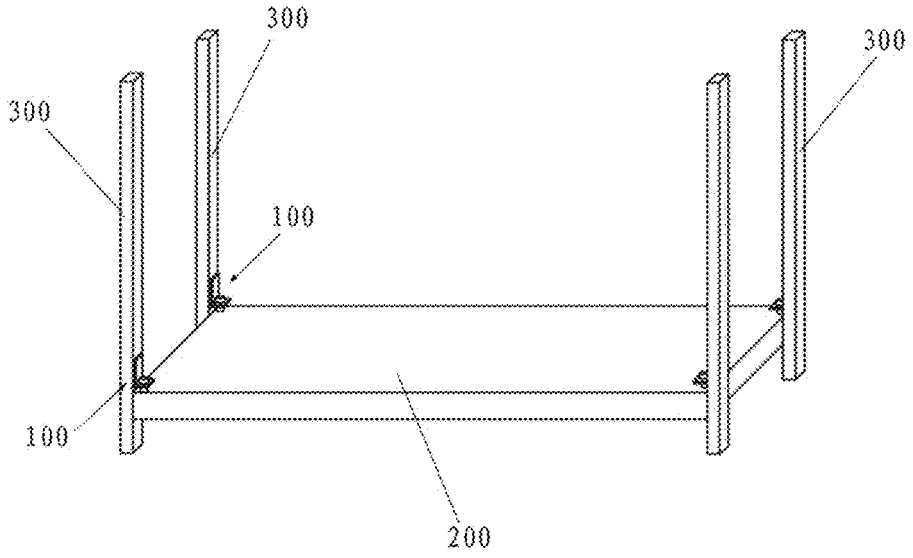
FIG. 3 is a partial schematic perspective view of an elevator frame according to one embodiment of the present application.

FIG. 3 is a partial schematic perspective view of an elevator frame according to one embodiment of the present application. The horizontal connection member 200 is shown as being substantially rectangular, and vertical connection members 300 and 400 are provided at both sides thereof, respectively. For example, two vertical connection members 300 may be connected at one side of the horizontal connection member 200, and each of the vertical connection members 300 is respectively provided with a position adjusting device 100 for elevator frame as described above. Similarly, two vertical connection members 400 may also be connected at the other side of the horizontal connection member 200, and each of the vertical connection members 400 may also be provided with a position adjusting device 100 for elevator frame. By individually or simultaneously adjusting the adjusting mechanisms in the position adjusting devices 100 for elevator frame, it is possible to make a plurality of vertical connection members cooperate with each other, and ensure that the positioning of various vertical connection members in the vertical direction can match with each other, thereby facilitating subsequent connection operations. For example, when the relative positional relationship between the vertical connection member and the horizontal connection member is adjusted to the desired state, various vertical connection members and the horizontal connection member may be fixed together by riveting, bolting, or welding.

In one embodiment, the position adjusting device 100 for elevator frame can be removed from the elevator frame 10 after the vertical connection members and the horizontal connection members are fixed together. In another embodiment, the position adjusting device 100 for elevator frame may be retained within the elevator frame 10.

The plank or vertical connection member 200 is employed as an example herein to describe the position adjusting device 100 for elevator frame. However, the position adjusting device 100 for elevator frame may also be applicable to other vertical connection members. For example, the position adjusting device 100 for elevator frame may be applied to the horizontal connection members 201, 202, or 203 shown in FIG. 1. The position adjusting device 100 for elevator frame is also not limited to being mounted on the top surface of the horizontal connection member as shown in FIGS. 2 and 3, but may also be mounted on the bottom surface or other surfaces of the horizontal connection member.

The present application also provides an elevator that includes the position adjusting device for elevator frame as described above or the elevator frame as described above.

The present application also provides a position adjusting method for elevator frame. Specifically, during the process of assembling various horizontal connection members and vertical connection members as shown in FIG. 1, firstly, a plurality of vertical connection members for elevator frame are positioned adjacent to the horizontal connection members for elevator frame. Then, the position adjusting devices 100 for elevator frame are mounted on the side surfaces of each vertical connection member, such that the tips of the rods of the adjusting mechanisms are adjacent to the surface of the horizontal connection members. After the mounting operation is completed, the rods are rotated by the operator with a tool, thereby causing the adjusting mechanisms to move in the vertical direction, so as to adjust the relative positional relationship between the vertical connection members and the horizontal connection members. When the relative positional relationship between the vertical connection members and the horizontal connection members is adjusted to a desired state, the vertical connection members are fixed with respect to the horizontal connection members.

During the operation, a variety of relative positional relationships between the vertical connection member and the horizontal connection member may be adjusted, including but not limited to: adjusting the front to back alignment relationship of the vertical connection member (i.e., the alignment relationship along X axis and/or Y axis in FIG. 1), adjusting the torsion angle of the vertical connection part (i.e., rotating or twisting about the Z axis in FIG. 1), or adjusting the position of the vertical connection members in the vertical direction (i.e., the position along the Z axis in FIG. 1). After the adjustment is completed, the vertical connection member and the horizontal connection member may be fixed by means of bolts, riveting or welding, and the like.

In one embodiment, after the vertical connection member is fixed with respect to the horizontal connection member, the position adjusting device 100 for elevator frame may be removed. In another embodiment, the position adjusting device 100 for elevator frame may be retained within the elevator frame.

This specification discloses this application with reference to the drawings, and also enables those skilled in the art to implement this application, including making and using any devices or systems, selecting suitable materials, and using any combination of methods. The scope of the present application is defined by the claimed technical solution, and contains other examples that occur to those skilled in the art. As long as such other examples include structural elements that are not different from the literal language of the claimed technical solution, or such other examples include equivalent structural elements that are not substantially different from the literal language of the claimed technical solution, then such other examples should be considered to be within the scope of protection determined by the technical solution claimed by this application.

What is claimed is:

1. A position adjusting method for an elevator frame, the method comprising:

positioning a plurality of vertical connection members for the elevator frame adjacent to a horizontal connection member for the elevator frame;

disposing a position adjusting device for the elevator frame on a side surface of the vertical connection member for the elevator frame, wherein the position adjusting device comprises: a connection portion configured to selectively attach to a side surface of the vertical connection member; a matching portion extending on a plane perpendicular to the connection portion and including one or more threaded through holes; and one or more adjusting mechanisms each including a head and a threaded rod, the rod being configured to match with the threaded through hole, and a tip of the rod being configured to contact a surface of a horizontal connection member; and wherein tips of the rods of the one or more adjusting mechanisms are positioned adjacent to the surface of the horizontal connection member for the elevator frame;

adjusting a relative positional relationship between the vertical connection member for the elevator frame and the horizontal connection member for the elevator frame by rotating the rod; and fixing the vertical connection member for the elevator frame with respect to the horizontal connection member for the elevator frame.

2. The method according to claim 1, wherein the connection portion is configured to be removably attached to the side surface of the vertical connection member for the elevator frame.

3. The method according to claim 2, wherein the connection portion is provided with a plurality of mounting holes, and the connection portion is attached to the side surface of the vertical connection member for the elevator frame through the plurality of mounting holes.

4. The method according to claim 1, wherein the connection portion is attached to the side surface of the vertical connection member for the elevator frame by welding.

5. The method according to claim 1, wherein one or more reinforcing ribs are attached between the matching portion and the connection portion.

6. The method according to claim 1, wherein the adjusting mechanism includes a bolt.

7. The method according to claim 1, wherein the one or more threaded through holes are configured to extend in a vertical direction.

8. The position adjusting method according to claim 1, wherein adjusting the relative positional relationship between the vertical connection member for the elevator frame and the horizontal connection member for the elevator frame comprises: adjusting front to back alignment relationship, adjusting the torsion angle of the vertical connection member for the elevator frame, or adjusting a position of the vertical connection member for the elevator frame in a vertical direction.

9. The position adjusting method according to claim 1, wherein fixing the vertical connection member for the elevator frame with respect to the horizontal connection member for the elevator frame includes fixing by bolts or welding.

10. The position adjusting method according to claim 1, wherein after the vertical connection member for the elevator frame is fixed with respect to the horizontal connection member for the elevator frame, the position adjusting device for the elevator frame is removed.

11. The position adjusting method according to claim 1, wherein the elevator frame comprises:

at least two horizontal connection members;

a vertical connection member matching with each of the horizontal connection members; and a plurality of additional position adjusting devices, the connection portions of each additional position adjusting device being respectively attached to each of the vertical connection members, and the tips of the rods being cooperative with the surface of the vertical connection member, so as to adjust the relative positional relationship between the horizontal connection member and the vertical connection member.

12. The position adjusting method according to claim 1, wherein the elevator frame is part of an elevator.

* * * * *